US005635466A

United States Patent [19]

Burdon et al.

[11] Patent Number: 5,635,466

[45] Date of Patent: Jun. 3, 1997

[54] CONCENTRATED LIQUID DETERGENT COMPOSITION COMPRISING AN ALKYL ETHER SULPHATE AND A PROCESS FOR MAKING THE COMPOSITION

[75] Inventors: Allan Burdon, Ashington, England; Katherine J. Cope, West Jesmond, Great Britain; Wendy Coppenrath, Temse; Guy Stasino, Kieldrecht, both of Belgium; Brian E. Talkes, Morpeth, England; Stefano Zenezini, Uccle, Belgium

[73] Assignee: The Procter & Gamble Company, Cincinnati, Ohio

[21] Appl. No.: 382,015

[22] PCT Filed: Aug. 12, 1993

[86] PCT No.: PCT/US93/07700

§ 371 Date: Oct. 20, 1995

§ 102(e) Date: Oct. 20, 1995

[87] PCT Pub. No.: WO94/04640

PCT Pub. Date: Mar. 3, 1994

[30] Foreign Application Priority Data

Aug. 21, 1992 [EP] European Pat. Off. ..... 92202559

[51] Int. Cl.$^6$ ..... C11D 1/37; C11D 1/831

[52] U.S. Cl. ..... 510/341; 510/340; 510/339; 510/427; 510/351; 510/502

[58] Field of Search ..... 510/427, 502, 510/339, 340, 351, 341

[56] References Cited

U.S. PATENT DOCUMENTS

| | | | |
|---|---|---|---|
| 4,129,515 | 12/1978 | Foster | 252/117 |
| 4,133,779 | 1/1979 | Hellyer et al. | 252/547 |
| 4,169,078 | 9/1979 | Spicuzza, Jr. et al. | 260/17.3 |
| 4,435,317 | 3/1984 | Gerritsen et al. | 252/547 |
| 4,549,984 | 10/1985 | Satsuki et al. | 252/532 |
| 4,671,894 | 6/1987 | Lamb et al. | 252/545 |
| 4,923,635 | 5/1990 | Simion et al. | 252/545 |
| 5,096,622 | 3/1992 | Simion et al. | 252/548 |
| 5,382,386 | 1/1995 | Jakubicki et al. | 252/548 |

*Primary Examiner*—Paul Lieberman
*Assistant Examiner*—Necholus Ogden
*Attorney, Agent, or Firm*—George W. Allen

[57] ABSTRACT

A concentrated aqueous surfactant solution comprising alkyl ether sulphate and alkaline earth metal, preferably magnesium. The composition is a stable liquid which is suitable for making into cleaning products, especially dish washing liquids. The concentrated surfactant solution can be prepared by partial neutralisation of the acid precursor with the hydroxide or oxide of the alkaline earth metal, followed by a further neutralisation with the hydroxide of an alkali metal or ammonium.

5 Claims, No Drawings

CONCENTRATED LIQUID DETERGENT COMPOSITION COMPRISING AN ALKYL ETHER SULPHATE AND A PROCESS FOR MAKING THE COMPOSITION

BACKGROUND OF THE INVENTION

Recent trends in the detergent industry have been towards delivering a more concentrated product to the consumer. This has the benefits of both smaller and lighter bottles, boxes etc. for the consumer to handle, as well as lowering the requirement for packaging materials. Decreasing the packaging materials in turn reduces the load on waste disposal into the environment.

With this in mind it has been the goal of detergents manufacturers to produce raw materials which have a higher concentration of active detergent ingredients. This goal challenges the manufacturers to formulate, and develop processes for, compositions which are increasingly concentrated, but still stable over a period of time.

This invention provides a stable concentrated aqueous or aqueous/alcohol solution of an alkyl ether sulphate useful as a component in formulating cleaning products especially dish washing liquids.

The solution contains alkaline earth metal ions, which are known to boost performance of dish washing formulations, but very few or no chloride or sulphate ions, which have a detrimental effect on the stability of concentrated solutions and on finished products made from said concentrated solutions.

The invention also describes a two-stage neutralising process for making such compositions.

The composition may be used as a finished product in its own right, but preferably it will be mixed with other ingredients to produce a finished product. It is intended that the sulphating/neutralising processes may be carried out at locations remote from the sites were the finished product is blended. This allows for .economical and flexible manufacturing and transportation.

The use of magnesium cations as performance boosters in dish washing liquids for at least part of the anionic surfactant has been widely disclosed in the prior art, for example, British patent numbers 1 524 441 and 1 551 074 and British published patent application 2 010 893.

U.S. Pat. No. 4,133,779, published on Jan. 9th, 1979, discloses a detergent composition comprising anionic and nonionic semipolar surfactants. It suggests that a concentrated liquid/paste containing from 45% to 95% active surfactant (which can be alkyl ether sulphate) can be made. Neutralisation by magnesium hydroxide is one of a number of options, but no process details are given, and no incentive to avoid chloride or sulphate ions is suggested. Indeed addition of magnesium in the form of magnesium sulphate is preferred. These compositions contain at least 1% of a semi polar nonionic surfactant.

EP 039110, published Nov. 4th, 1981, says that chloride and sulphate ions should be avoided or minimised because additional chloride or sulphate ions can increase the chill point temperature (the temperature at which inorganic salts precipitate as crystals in the finished product). EP 039110 deals with compositions of alkyl ether sulphate in combination with other surfactants, especially linear alkyl benzene sulphonate and alkyl sulphate in finished products. These finished products are not concentrated, and therefore the level of alkyl ether sulphate is around 10%. Neutralisation with mixed sodium/magnesium cations is disclosed.

EP 181212, published on May 14th, 1986, discloses that neutralisation of the alkyl ether sulphuric acid and the alkyl sulphuric acid can be carried out with the appropriate alkali or with a magnesium oxide or hydroxide slurry which avoids the addition of chloride or sulphate ions. This publication also describes detergent compositions comprising 22% to 65% by weight of a surfactant system composed of a mixture of anionic, nonionic, and zwitterionic surfactants in an organic solubiliser/hydrotrope-water medium. However this disclosure is limited to less than 24% by weight of alkyl ether sulphate.

U.S. Pat. No. 4,169,078, published on Sep. 25th, 1979 and EP 487170, published on May 27th, 1992, both deal with neutralisation processes for use with light duty liquid detergents. However, both of these disclosures are directed towards compositions comprising alkyl benzene sulphonic acid.

U.S. Pat. No. 4,129,515, published on Dec. 12th, 1978, describes a neutralisation process for various detergent sulphates and sulphonates. Here, the neutralisation is completed with alkanolomines, and the resulting compositions are intended mainly for washing fabrics.

It is the aim of the present invention to provide for a highly concentrated alkyl ether sulphate solution which is stable over time and during storage. The composition contains alkaline earth metal ions which are known performance boosters in dish washing liquids. However, the compositions contain a very low level, of chloride or sulphate ions.

It is a further aim of the invention to provide a process for making such compositions.

It is a further aim of the invention to provide a process for making stable compositions which comprise alkyl ether sulphate and which also comprise nonionic surfactants based on polyhydroxy groups such as those derived from sugars.

SUMMARY OF THE INVENTION

An aqueous solution comprising from 50% to 90% by weight of alkyl ether sulphate which is associated with counterions chosen from alkali metal ions, alkaline earth metal ions or ammonium ions, or mixtures thereof, and which comprises at least 0.5% by weight of alkaline earth metal, preferably magnesium, ions and low levels of chloride or sulphate ions. Specifically the molar ratio of the alkaline earth metal to (the sum of chloride and inorganic sulphate) is greater than 1:1, preferably greater than 3:2.

These compositions may be made by a neutralisation process comprising two stages. In the first stage the acid form of the alkyl ether sulphate is partly neutralised by a slurry of alkaline earth metal hydroxide, preferably magnesium hydroxide or alkaline earth metal, preferably magnesium oxide. In the second stage further neutralisation is carried out in the presence of another alkali, such as sodium hydroxide.

Optionally, either a short chain alcohol, a hydrotrope, or other surfactants may be present in either or both stages of the neutralisation for viscosity control and improved stability of the product.

DETAILED DESCRIPTION OF THE INVENTION

Detergent compositions in accordance with the present invention comprise from 50% to 90% by weight, preferably 60% to 80% by weight of alkyl ether sulphate, together with at least 0.5% by weight, preferably at least 1% by weight of an alkaline earth metal, preferably magnesium. The compositions comprise low levels of chloride or sulphate. (As referred to herein, "sulphate" means $SO_4^{2-}$, either as an ion or as an inorganic salt. The term excludes the sulphates of ethoxylated alcohols or other organic surfactants).

Optionally the composition may also comprise from 0% to 20% of a short chain alcohol, a hydrotrope, other surfactants or a mixture of these. Preferably the alcohol is chosen from ethanol or propylene glycol and, preferably, the hydrotrope is preferably an anionic aromatic hydrotrope such as cumene sulphonate, xylene sulphonate, or urea, other surfactant is preferably chosen from nonionic surfactant, polyethylene glycol or betaine.

The alkyl ether sulphate component comprises a primary alkyl ether sulphate derived from the condensation product of a C10–C20 alcohol with an average of up to 8 ethylene oxide groups. The alcohol itself can be obtained from natural fats or Ziegler olefin build-up or OXO synthesis. Examples of synthetically derived materials include Dobanol 23®, sold by Shell Chemicals (UK) Ltd Ethyl 24® sold by Ethyl Corp., a blend of C13–C15 alcohols in the ratio of 67% C13, 33% C15 sold under the trade name Lutensol by BASF GmbH and Synprol® from ICI plc, and Lial 125® sold by Liquichemica® Italia. Examples of naturally occurring materials from which the alcohols can be derived are coconut oil and palm kernel oil and the corresponding fatty acids.

C12–15 alkyl ether sulphates are preferred, and C12–13 alkyl ether sulphates are most preferred.

Conventional base-catalysed ethoxylation processes result in a distribution of individual ethoxylates, so that the desired average can be obtained in a variety of ways. Blends can be made of material having different degrees of ethoxylation and/or different ethoxylate distributions arising from the specific ethoxylation techniques employed and subsequent processing steps such as distillation. The average number of ethoxylate groups per molecule of alkyl ether sulphate should be less than 8, and preferably less than 4. A average ethoxylation level of about 0.8 is particularly suitable for use in this invention.

Sulphation of the alcohol ethoxylate can employ any of the conventional sulphating agents such as sulphur trioxide or chlorosulphonic acid. The sulphation process may be carried out in a falling film reactor, or in a batch reactor, or in any other suitable sulphating equipment. A continuous process using a falling film reactor is preferred in order to minimise degradation of the unstable acid surfactant prior to neutralisation.

It is consistent with the invention to maximise the completeness of the sulphation reaction in order to minimise the levels of inorganic sulphate or chloride which are present in the neutralised composition.

In order to control the viscosity of the concentrated surfactant composition and to ease subsequent handling and/or processing steps, it may be useful to add short chain alcohols containing from 2 to 5 carbon atoms. For example, ethanol, propylene glycol, isopropanol and butanol may be used, preferably ethanol is used. Alternatively hydrotropes may be used as viscosity regulators/stabilising agents. For example cumene sulphonate, xylene sulphonate and urea may be used.

Neutralisation Process

The neutralisation process of the present invention is carried out in two stages. In the first stage the acid form of the sulphated ethoxylated alcohol is partly neutralised by a slurry of alkaline earth metal, preferably magnesium, hydroxide or alkaline earth metal, preferably magnesium oxide, preferably with a solids content of at least 30%. The neutralisation is preferably carried out continuously using a conventional neutralisation loop comprising a high shear mixer in which the acid and base are rapidly and intimately mixed, a pump and a heat exchanger. Some of the neutralised product is then allowed to pass to the next process stage, whilst the rest is returned to the high shear mixer. Normally the fraction of product allowed to leave the loop and pass to the next processing stage is from 6% to 25% by weight, preferably from 9% to 17% by weight, whilst the remainder of the product continues around the loop.

It is an essential feature of the invention that the product at the exit of the heat exchanger shall be less than pH4, preferably about pH3. pH control may be effected by the addition of another alkaline solution into the first neutralisation loop, as well as the alkaline earth metal hydroxide/oxide. Preferably, the additional alkaline solution, if present, is sodium, potassium, or ammonium hydroxide solution.

Viscosity may be controlled, if necessary, by addition of short chain alcohol, hydrotropes, or other ingredients commonly used in detergents, such as surfactants, into the first neutralisation loop.

The concentration of the intermediate product leaving the neutralisation loop may be adjusted by the addition of water to the neutralisation loop.

Other detergent ingredients may be added, such as nonionic surfactants and/or betaine.

The intermediate product leaving the first neutralisation loop is then passed directly to a second neutralisation loop where the neutralisation is completed. The second neutralisation loop also comprises a high shear mixer, a pump and a heat exchanger. The intermediate product from the first heat exchanger is mixed with an alkaline solution in the high shear mixer in order to complete the neutralisation. The product leaving the neutralisation loop should be at least pH7, preferably from pH7 to pH9, most preferably about pH8.

Any suitable alkaline solution may be used in the second neutralisation loop, preferred alkaline solutions are sodium, potassium and ammonium hydroxide.

Short chain alcohols, hydrotropes, water or mixtures of these, may also be added into the second neutralising loop, although it will generally be more advantageous to add these components via the first neutralisation loop.

Although not essential, it is preferred that all of the alkaline earth metal ions are introduced via the first neutralisation loop.

Further Processing

It is intended that the detergent composition made by the present invention may be stored and transported as required by manufacturing operations. The compositions may then be mixed with additional detergent ingredients prior to packing and shipping to consumers. The additional detergent ingredients used will be chosen by the formulator from a wide range of active ingredients. For example, additional surfactants which are anionic, nonionic, or zwitterionic in nature, suds promoting agents such as alkanolamides, opacifiers, thickeners, anti-tarnish agents, heavy metal chelating agents are all useful in a finished dish washing liquid composition.

In particular, it is preferred that the concentrated alkyl ether sulphate composition of the invention is blended with nonionic surfactant(s) in order to give formulations which are particularly suitable for dish washing liquids. Nonionic surfactant(s) may be present in compositions of the invention at levels of from 0% to 50% by weight. The present invention has been found to be particularly useful when used to make finished compositions which comprise nonionic surfactants based on polyhydroxy groups such as those derived from sugars. Nonionic surfactants of this type include polyhydroxy fatty acid amides and alkyl polyglucosides.

The preferred polyhydroxy fatty acid amides include alkyl N-methyl glucamide in which the alkyl chain may contain between 8 and 22 carbon atoms, preferably from 12 to 18 carbon atoms, and in particular coconut N-methyl glucamide containing predominantly alkyl groups of 12 and 14 carbon atoms. Suitable processes for preparing these polyhydroxy fatty acid amides are disclosed in WO 92/06984.

The preferred alkyl polyglucosides include those having an alkyl group containing from about 12 to about 18 carbon atoms and a polyglucoside hydrophilic group containing, on average, from about 1.5 to 4 glucoside units. Suitable alkyl polyglucosides are dodecyl, tetradecyl, hexadecyl, and octadecyl, di-, tri-, tetra-, penta- and hexaglucosides and mixtures thereof. Further descriptions of alkyl poly glucosides are given in EP 70074.

In preferred finished product compositions, polyhydroxy fatty acid amide or alkyl poly glucoside, or mixtures thereof is present at a level of at least 1% by weight, preferably at least 5% by weight.

EXAMPLES

A detergent composition was made according to the present invention comprising:

| | |
|---|---|
| AE0.8S (acid form) | 70% |
| $Mg(OH)_2$ (33% slurry) | 8% |
| NaOH (50% soln.) | 13% |
| Water | 4.5% |
| Ethanol | 4.5% |

The acid form of the alkyl ether sulphate, with an average number of ethoxylate groups per molecule of alkyl ether sulphate of 0.8 (AE0.8S), was made by continuous sulphation of the corresponding ethoxylated alcohol on a falling film reactor. The alkyl chain was predominantly a mixture of C12 and C13 chain lengths (Dobanol 23®, supplied by Shell). The acid was injected into the high shear mixer of the first neutralisation loop at a rate of 1.5 tonnes/hour. All of the magnesium hydroxide needed for the final composition was added into the loop, along with 60% of the sodium hydroxide solution. The water and ethanol were also added into the first loop.

The partly neutralised sulphate leaving the neutralisation loop, just after the exit of the heat exchanger had a temperature of 40° C. and pH3. This sulphate was then injected directly into the high shear mixer of the second neutralisation loop.

The remaining 40% of the sodium hydroxide solution was also pumped into the second loop, and neutralisation of the sulphate was completed. The product leaving the second neutralisation loop, after the heat exchanger had a temperature of 40° C. and pH8.

The product made in this example was analysed and found to contain 1.1% by weight of magnesium, 0.6% of chloride, and 1.0% of sulphate. Expressed in moles% this is 0.045 mol % magnesium, 0.016 mol % chloride and 0.01 mol % sulphate. The molar ratio of magnesium to sulphate and chloride being (0.045):(0.01+0.016) which is 1.7:1 (or 1:0.6). It was stable upon storage, showing no phase separation or viscosity drift even after storage at 50° C. for one week.

The high active surfactant composition of this example was further processed to make a finished product by mixing with an ethoxylated alcohol with an average of 8 ethoxylate groups per molecule and a carbon chain length of 10 (C10 AE8), with a coconut N-methyl glucamide, and with other ingredients as defined below (all % are by weight of finished product):

| | |
|---|---|
| Surfactant Composition | 20% |
| C10 AE8 | 8% |
| N-methyl glucamide | 8% |
| C12/14 betaine | 2% |
| Ethanol | 5% |
| Sodium cumene sulphonate | 2% |
| Dye/perfume | 1% |
| Water | to balance |

This finished product was also stable upon storage.

Comparative Example 2

The concentrated surfactant composition in example 1 was remade, replacing magnesium hydroxide by magnesium chloride in order to get the same level of magnesium (1.1%) in the surfactant composition:

| | parts |
|---|---|
| AE0.8S (acid form) | 70 |
| NaOH (50% soln.) | to pH 8 |
| Water | 4.5 |
| Ethanol | 4.5 |
| $MgCl_2$ | 4.3 |

The product made in this example was analysed and found to contain 1.1% by weight of magnesium, 3.71% of chloride, and 0.32% of sulphate. Expressed in moles % this is 0.045 mol % magnesium, 0.11 mol % chloride and 0.003 mol % sulphate. The molar ratio of magnesium to sulphate and chloride being (0.045):(0.11+0.003) which is 1:2.5.

Although the concentrated surfactant composition defined in this example was stable, the finished product made using this surfactant composition, according to the formulation of example 1 was found to be unstable.

Comparative Example 3

The same high active surfactant composition as made in example 2 was repeated with a further 4.3 parts of magnesium chloride added. This concentrated surfactant composition was not stable, and rapidly separated into three separate phases.

The product made in this example was analysed and found to contain 2.2% by weight of magnesium, 6.9% of chloride, and 0.32% of sulphate. Expressed in moles% this is 0.092 mol % magnesium, 0.2 mol % chloride and 0.003 mol % sulphate. The molar ratio of magnesium to sulphate and chloride being (0.092):(0.2+0.003) which is 1:2.2.

This concentrated surfactant composition was not stable and showed phase separation.

We claim:

1. A process for the neutralisation of the acid precursor of alkyl ester sulphate, comprising the steps of i) partly neutralising the acid precursor of the alkyl ether sulphate with an alkali or alkalis which comprises an aqueous slurry of alkaline earth metal hydroxide, alkaline earth metal oxide, or mixtures thereof, such that the pH of the product is less than 4, ii) further neutralising the product of (i), such that the pH of the product is at least 7, iii) addition of a nonionic surfactant comprising at least 1% by weight of a polyhydroxy fatty acid amide, polyglucoside or a mixture thereof, characterised in that process steps (i) and (ii) are carried out in continuous neutralisation loops and that the neutralisation loops are connected in series, and that the neutralisation of step (ii) is carried out by an alkali metal hydroxide or ammonium hydroxide.

2. A process according to claim 1, wherein the poly hydroxy fatty acid amide is a N-methyl glucamide comprising an alkyl chain of from 8 to 22 carbon atoms.

3. A process according to claim 1 in which an alcohol having from 2 to 5 carbon atoms, anionic aromatic hydrotrope, a surfactant, or mixtures thereof is added in step (i) into the first neutralisation loop.

4. A process according to claim 1 wherein the nonionic surfactant of step (iii) comprises at least 5% of a polyhydroxy fatty acid amide, or alkyl poly glucoside, or a mixture thereof.

5. A process according to claim 2 wherein said N-methyl glucamide comprises an alkyl chain of from 12 to 18 carbon atoms.

* * * * *